US008253293B2

(12) United States Patent
Su

(10) Patent No.: US 8,253,293 B2
(45) Date of Patent: Aug. 28, 2012

(54) MAGNETIC FAN DEVICE

(75) Inventor: Hung-Ti Su, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 106 days.

(21) Appl. No.: 12/912,772

(22) Filed: Oct. 27, 2010

(65) Prior Publication Data

US 2012/0062060 A1 Mar. 15, 2012

(30) Foreign Application Priority Data

Sep. 14, 2010 (CN) ..... 2010 1 0281348

(51) Int. Cl.
*H02K 7/09* (2006.01)

(52) U.S. Cl. ..... 310/90.5; 415/213.1; 415/119; 310/51

(58) Field of Classification Search ..... 310/89, 310/90, 90.5, 51; 415/213.1, 214.1, 119; 417/356

See application file for complete search history.

(56) References Cited

U.S. PATENT DOCUMENTS 4,459,087 A * 7/1984 Barge ..... 417/356
5,959,383 A * 9/1999 Winzen et al. ..... 310/90.5
6,268,674 B1 * 7/2001 Takahashi ..... 310/90.5
6,744,172 B2 * 6/2004 Duhua ..... 310/254.1
7,255,529 B2 * 8/2007 Ku et al. ..... 415/119
7,281,893 B2 * 10/2007 Pan ..... 415/177
7,351,032 B2 * 4/2008 Horng et al. ..... 415/213.1
8,018,100 B2 * 9/2011 Popov ..... 310/51
2002/0074881 A1 * 6/2002 Imlach ..... 310/90.5
2008/0116757 A1 * 5/2008 Chang et al. ..... 310/90.5

FOREIGN PATENT DOCUMENTS

JP 01177496 A * 7/1989

* cited by examiner

*Primary Examiner* — Quyen Leung
*Assistant Examiner* — Naishadh Desai
(74) *Attorney, Agent, or Firm* — Altis Law Group, Inc.

(57) ABSTRACT

A magnetic fan device includes a stator, at least three bearings fixed on the stator, a rotor fixedly connected to the stator, a motor, and at least three magnetic posts. The at least three bearings are permanent magnets. The rotor includes a shaft and a plurality of impellers rotatably connected to the shaft. The at least three magnetic posts with an opening at its lateral surface are configured for respectively receiving the at least three bearings by the opening. A first magnet is adhered to ends of the at least three magnetic posts, and a second magnet is adhered to opposite ends of the at least three magnetic posts. The magnetic pole of the first magnet adjacent to ends of the at least three bearings is opposite to the magnetic pole of the second magnet adjacent opposite ends of the at least three bearings.

5 Claims, 2 Drawing Sheets

MAGNETIC FAN DEVICE

BACKGROUND

1. Technical Field

The present disclosure relates to device cooling and, particularly, to a magnetic fan device with reduced vibration.

2. Description of Related Art

Electronic devices, such as notebook computers, generate heat which must be dissipated by a fan device in order that the service life of the electronic device is prolonged. The fan device often includes a housing, a stator fixed in the housing, and a rotor rotatably connected to the stator. Due to frequent rotation of the rotor, the stator can wear out, and vibrate relative to the housing as a result.

Therefore, what is needed is a magnetic fan device to overcome the described shortcoming.

DETAILED DESCRIPTION

Figure 1:
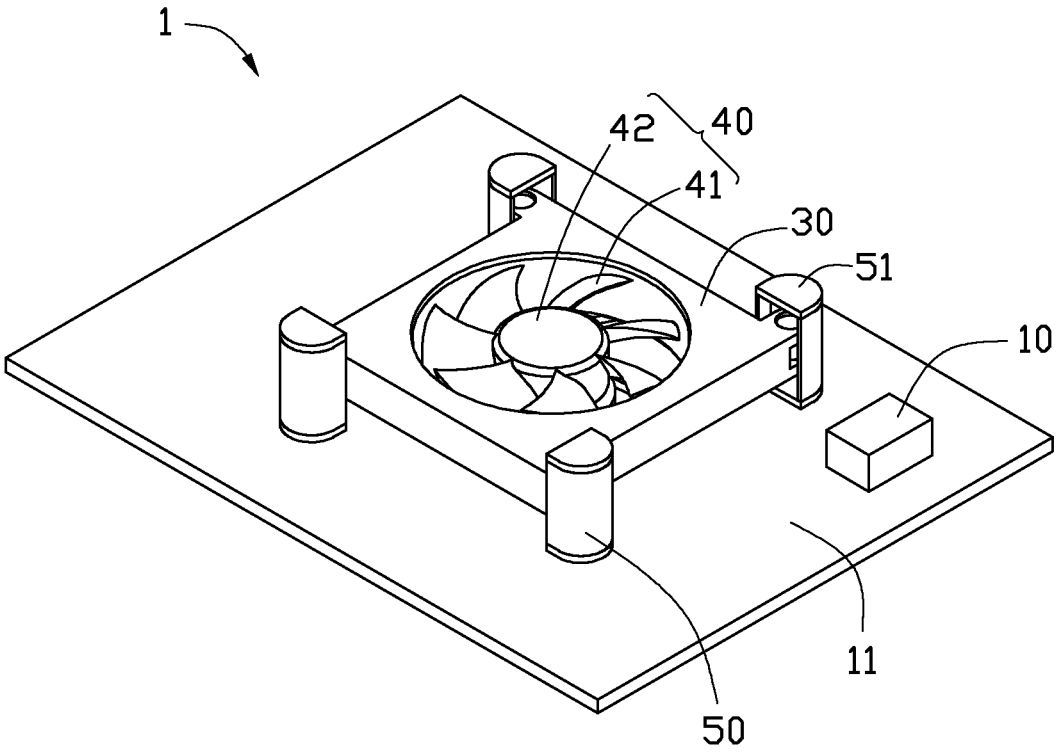
FIG. 1 is an isometric view of a magnetic fan device in accordance with an exemplary embodiment.
Figure 2:
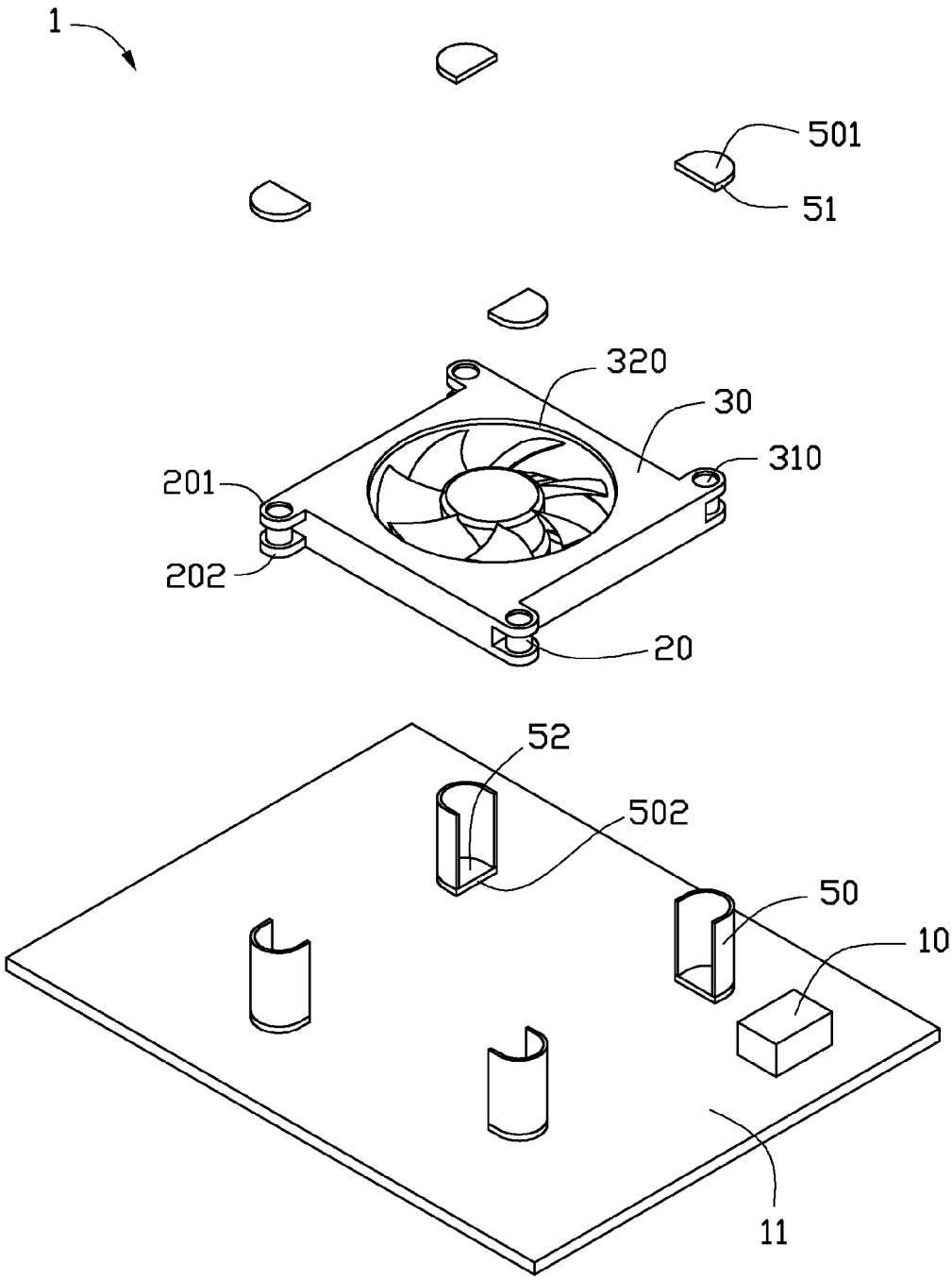
FIG. 2 is an exploded view of the magnetic fan device of FIG. 1.

Referring to FIGS. 1-2, an embodiment of a magnetic fan device 1 is illustrated. The magnetic fan device 1 includes a motor 10, a stator 30, at least three bearings 20 fixed on the stator 30, a rotor 40, and at least three magnetic posts 50 with an opening in its lateral surface. The at least three bearings 20 each include a first end 201 and a second end 202 opposing to the first end 201. The rotor 40 is fixed to the stator 30. A first magnet 51 is adhered to ends of the at least three magnetic posts 50, and a second magnet 52 is adhered to opposite ends of the at least three magnetic posts 50. The magnetic pole of the first magnet 51 adjacent to the first end 201 of the at least three bearings 20 is opposite to the magnetic pole of the second magnet 52 adjacent to the second end 202 of the at least three bearings 20. The at least three bearings 20 are permanent magnets, and respectively received in the at least three magnetic posts 50. Since the magnets of the like polarity will repel and those of different polarity will attract, when the magnetic force between the bearing 20 and the first magnet 51 and the magnetic force between the bearing 20 and the second magnet 52 overcome a limitation of the gravity of the bearing 20 and the stator 30 and the rotor 40, the stator 30 and the at least three bearings 20 will be respectively suspended in a space of among at least three magnetic posts 50, thereby reducing vibration of the fan device 1. In one embodiment, the at least three bearings 20 are cylindrical, and four bearings 20 deployed. In order to better understand the disclosure, an exemplary embodiment follows in detail.

The magnetic fan device 1 further includes a base 11. The at least three magnetic posts 50 are fixed on a top surface of the base 11.

The stator 30 includes at least three extending portions 301 extending from an edge thereof. Each extending portion 301 defines a through hole 310. The at least three bearings 20 are respectively fixed in the through holes 310, thereby fixing the at least three bearings 20 to the stator 30. The stator 30 defines a rounded perforation 320 for receiving the rotor 40.

The rotor 40 includes a shaft 42 and a number of impellers 41 rotatably connected to the shaft 42. The motor 10 is electrically connected to the rotor 40, and is configured for providing a power supply for the impellers 41 to rotate about the shaft 42 in the rounded perforation 320.

The at least three magnetic posts 50 each includes a top 501 and a bottom 502. The top 501 is operable to separate from the magnetic post 50. The first magnet 51 is adhered to a bottom surface of the top 501. The second magnet 52 is adhered to a top surface of the bottom 502.

During assembly of the magnetic fan device 1, the at least three bearings 30 are respectively fixed to the through holes 310 of the stator 30. The rotor 40 is received in the rounded perforation 320 of the stator 30. The at least three bearings 20 are respectively placed in the magnetic posts 50, and then the tops 501 are covered. Due to magnetic action, the stator 30 and the at least three bearings 20 are respectively suspended in a space among the at least three magnetic posts 50.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A magnetic fan device comprising:

a stator;

at least three bearings fixed on the stator, wherein the at least three bearings are permanent magnets;

a rotor fixed to the stator, and comprising a shaft and a plurality of impellers rotatably connected to the shaft;

a motor electrically connected to the rotor, and configured for driving the plurality of impellers to rotate about the shaft; and at least three magnetic posts with an opening at their lateral surfaces, and configured for respectively receiving the at least three bearings by the opening; wherein a first magnet is adhered to ends of the at least three magnetic posts, and a second magnet is adhered to opposite ends of the at least three magnetic posts, the magnetic pole of the first magnet adjacent to ends of the at least three bearings is opposite to the magnetic pole of the second magnet adjacent to opposite ends of the at least three bearings.

2. The magnetic fan device as described in claim 1, further comprising a base, wherein the at least three magnetic posts are fixed on the base.

3. The magnetic fan device as described in claim 1, wherein the stator comprises at least three extending portions extending from an edge thereof, each of the at least three extending portions defines a through hole, the at least three bearings are respectively fixed in the at least three through holes.

4. The magnetic fan device as described in claim 1, wherein the stator defines a rounded perforation, the rotor is received in the rounded perforation.

5. The magnetic fan device as described in claim 1, wherein the at least three bearings are cylindrical.

* * * * *